United States Patent [19]

Schellenberg et al.

[11] Patent Number: 4,636,264

[45] Date of Patent: Jan. 13, 1987

[54] AUTODEPOSITION POST-BATH RINSE PROCESS

[75] Inventors: Lutz Schellenberg, Cologne; Matthias Hamacher, Huerth-Gleuel, both of Fed. Rep. of Germany; Ronald Broadbent, Ardsley, Pa.

[73] Assignee: Gerhard Collardin GmbH, Cologne, Fed. Rep. of Germany

[21] Appl. No.: 802,635

[22] Filed: Nov. 26, 1985

[30] Foreign Application Priority Data

Jan. 9, 1985 [DE] Fed. Rep. of Germany ..... 3500443

[51] Int. Cl.[4] ..... C23F 7/00; B05D 7/16

[52] U.S. Cl. ..... 148/6.2; 427/435; 427/409; 427/419.1

[58] Field of Search ..... 148/6.2; 427/435, 409, 427/419.1

[56] References Cited

U.S. PATENT DOCUMENTS

| | | | |
|---|---|---|---|
| 3,647,567 | 3/1972 | Schweri | 148/6.15 |
| 3,791,431 | 2/1974 | Steinbrecher et al. | 148/6.2 |
| 4,030,945 | 6/1977 | Hall et al. | 148/6.2 |
| 4,186,219 | 1/1980 | Hall | 427/8 |
| 4,186,226 | 1/1980 | Smith | 427/340 |
| 4,414,350 | 11/1983 | Hall | 524/320 |

*Primary Examiner*—Sam Silverberg

*Attorney, Agent, or Firm*—Ernest G. Szoke; Henry E. Millson, Jr.; Mark A. Greenfield

[57] ABSTRACT

A process for increasing the anticorrosive properties of an autodeposited coating wherein after the bath but before the curing, metallic chromate salts are formed in situ by first rinsing with metallic non-chromate water soluble salts and then rinsing with a chromium compound.

16 Claims, No Drawings

AUTODEPOSITION POST-BATH RINSE PROCESS

BACKGROUND OF THE INVENTION

1. Field of the Invention

This invention relates to improving the anticorrosive properties of an autodeposition coating by a post-bath rinse which introduces certain metal salts into the resin coating.

2. Statement of the Related Art

Inorganic pigments (i.e. insoluble colored substances) are capable of improving the anticorrosive properties of coatings which have been autodeposited on metal substrates. This is known from various publications. U.S. Pat. No. 4,030,945 discloses a process wherein metal surfaces, after they are autodeposition coated with organic resins, are rinsed with diluted aqueous solutions containing hexavalent chromium or combinations of hexavalent chromium with formaldehyde-reduced chromium compounds. In accordance with the disclosed process chromium compounds such as chromium trioxide (chromic acid), and/or water or acid soluble chromates or dichromates can be employed, especially potassium or sodium dichromate, or sodium, potassium, or lithium chromate.

Improving the corrosion resistance of metal surfaces autodeposition coated with resins has also been proposed in U.S. Pat. No. 4,186,226, which discloses using alkali metal chromates or dichromates in a post-bath rinse U.S. Pat. No. 3,647,567 discloses what appear to be autodeposited resin coatings which are subjected to a post-bath rinse using chromium trioxide, phosphoric acid, or water soluble or acid soluble chromates and dichromates. The specifically disclosed chromates or dichromates are: potassium, sodium, ammonium, calcium, cesium, lithium, magnesium, zinc, etc. (sic) chromates and sodium, ammonium, lithium, etc. (sic) dichromates, zinc chromate being preferred. In the only specific disclosure of such salts, (Example 3), a zinc "chromate" containing solution was prepared by adding an excess of zinc carbonate to a 10% aqueous chromium oxide solution. In the coating bath, various resin latices are disclosed, but the activating systems are oxidizing acid systems, specifically nitric acid or sulfuric acid when the substrate contains iron, zinc, or tin. A mixture of fluoroboric acid, hydrofluoric acid, chromic anhydride and potassium ferricyanide can also be employed as the activating system.

Theoretically, it is also possible to add inorganic pigments improving the autodeposition coating anticorrosive property directly into the coating bath and deposit same along with the organic resin layer on the metal surface. Known anticorrosive pigments include compounds of barium, strontium, zinc and lead, the chromates of said metals being preferably used. Such chromates without exception are only sparingly soluble in water. As is known from numerous printed publications, the autodeposition method is such that the acidic latex superficially mordants the metal surface to be coated, thereby dissolving metal ions of the metal surface into the solution. Such positive charge carriers cause the stabilized resin dispersion to coagulate in the proximity of the metal surface, whereby a homogeneous coating with the organic resin is effected without electricity. Due to the low pH of this coating process (between 1.5 and 4.0) such anticorrosive pigments are more or less rapidly converted into a soluble form, and theoretically should then be deposited simultaneously with the organic resin particles. However, the metal cations present in the acidic aqueous solutions contribute to an increased coagulation of the resin dispersion which may even result in a breakdown of the latex due to its complete coagulation.

DESCRIPTION OF THE INVENTION

It has been found that stable organic resin layers having excellent anticorrosive properties can be obtained on metal substrates, if after the actual autodeposition coating reaction and prior to curing the resin, the uncured surfaces are contacted with a first post-bath rinse comprising an aqueous metal salt solution and then contacted with a second post-bath rinse comprising an aqueous solution containing hexavalent and optionally also trivalent chromium. Those metal salts from the first rinse that have remained in the uncured resin are converted into chromates by the second rinse and subsequently the coating containing these chromates is cured and as a result the chromates are locked in to the resin.

Thus, the present invention relates to a process for improving the anticorrosive properties of autodeposited resin coatings on metal substrates which are mechanically and/or chemically cleaned by means of known procedures, autodeposition coated with any optional organic resin and, if desired, rinsed with water, and then (a) are contacted with an aqueous solution of at least one readily water-soluble non-chromate salt of strontium, barium, lead, iron(ferrous), nickel, copper or zinc at a pH of 4.5 to 8.5, as a first post-bath rinse; after which (b) those of the above metal salts which have remained in the uncured resin are converted into chromates by contacting with an aqueous solution containing hexavalent and optionally also trivalent chromium, as a second post-bath rinse; after which (c) the uncured resin coating now containing metal chromates is cured, preferably by heating at an elevated temperature.

Metal substrates which can be better protected against corrosion by application of the process of this invention comprise iron, tin, nickel, lead, chromium, zinc, aluminum, or alloys thereof, especially steel, as well as surfaces which have been coated with one of said metals or its alloys.

The organic resins to be autophoretically deposited on the metal surfaces may include a variety of resin materials in latex form as known from numerous publications. Examples of such organic coating-forming resin materials, for example, are polyethylene, polyacrylates, styrene/butadiene-copolymers, vinyl chloride/vinylidene chloride-copolymers and the like. Although virtually any autodepositable resin can be used in this invention, those which produce relatively soft coatings, such as acrylic and styrene-butadiene polymers are most improved in their anticorrosive properties by the process of the invention. For the actual coating procedure, the polymers are autodeposited according to known methods on metal surfaces which have been chemically and/or mechanically cleaned in the conventional manner. This type of process is described in U.S. Pat. Nos. 3,791,431; 4,186,219; 4,414,350, all of which are incorporated herein by reference, as well as in many other patents. If desired, the uncured coatings may be rinsed with water immediately after the actual coating reaction.

For the first post-rinse, any of the earlier mentioned metal cations are useful, although lead or nickel salts are preferred. The anions that are useful must form salts which are readily soluble in water with the corresponding cations. Moreover, they must not in any way adversely affect the finished product. For example, salts of the hydrogen halide acids or of sulfuric acid are not suitable for the invention, as their anions, e.g. $Cl^-$ and $SO_4^{2-}$, are known to corrode metal surfaces and, thus, the solutions thereof will not serve to increase, but rather to reduce, the corrosion resistance of the metal substrate.

Salts of the earlier mentioned metals formed with anions of organic carboxylic acids have proven to be particularly valuable for use in the inventive process. For example, acetates (ethanoates), propionates (propanoates), as well as salts of higher carboxylic or dicarboxylic acids can be employed. The acetates of these metals are particularly preferred, as it can be assumed that these anions are decomposed to form $CO_2$ and $H_2O$ when the autodeposited coating is cured in the presence of hexavalent chromium ions. Such decomposition products will not negatively influence the anticorrosive propeties imparted to the metal surfaces.

The amount of the metal salts in the aqueous rinse solutions with which the autodeposited uncured-resin coated metal substrates are treated according to this invention, may vary within wide limits. The salts of the first rinse are minimally used in an effective amount sufficient to provide an enhancement of the anticorrosive properties of the autodeposited resin after these salts are converted by the second rinse and the resin is cured. The chromates of the second rinse are minimally used in an effective amount sufficient to convert enough of those salts remaining in the resin after the first bath to water insoluble chromate salts which remain in the resin after curing, to provide the enhanced anticorrosive properties. For the first rinse, preferably 1 to 10 grams/liter, most preferably 2.5 to 7 grams/liter, of salts as measured by their cations are employed.

The pH value of the first rinse can be lowered within the above mentioned pH range of 4.5 to 8.5 using the acid which provides the employed salt's anion. Thus, solutions containing lead acetate or nickel acetate may be adjusted with acetic acid to a pH of 4.9 to 5.3.

The metal substrates autodeposition coated with the uncured organic resin as described above are contacted with the first rinse salt solutions according to known methods. For example, the coated metal substrates are immersed in the metal salt solutions, spray-treated with these solutions, or treated by a combined dip/spray-procedure. The duration of treatment is 30 to 120 seconds, and preferably about 90 seconds. During the treatment the salt solutions are at a temperature of 4° C. to 50° C., 20° C. being preferred.

In the course of contacting the autodeposited uncured resin surface with the first rinse aqueous metal salt solution, the salts are incorporated in the still soft organic resin layer. However, they are still accessible to further chemical reactions and, according to the invention, are treated in a subsequent step with an aqueous chromium-containing second rinse solution, as a result of which the respective organic metal salts are converted into the corresponding chromates.

The second rinse aqueous solution required for the step of converting the water-soluble metal salts into the corresponding chromates contains water-soluble hexavalent chromium compounds. Examples of such compounds are chromic acid, potassium dichromate, magnesium dichromate, potassium chromate and sodium chromate. Basically, any chromium-containing compound which forms hexavalent chromium ions in an acidic aqueous medium can be employed. Preferred hexavalent chromium sources are dichromates, for example calcium dichromate. Such solutions may also be prepared by adding a suitable salt, e.g. calcium carbonate, to an aqueous solution of chromic acid.

Solutions which contain trivalent chromium in addition to hexavalent chromium are preferred to be used. Such solutions may also be prepared according to prior art by partially reducing solutions containing hexavalent chromium with suitable reducing agents. One known route, comprises adding formaldehyde to a chromic acid solution to reduce part of the hexavalent chromium to trivalent chromium.

The mol ratio of trivalent to hexavalent chromium in such solutions is 0.3–3:1. In total the solutions contain 1 to 20, preferably 5 to 15 grams/liter of chromium.

The conversion of the metal salts incorporated in the uncured organic resin layer during the first rinse is also effected in accordance with known methods. The metal surfaces can either be immersed in the chromium containing aqueous salt solutions, spray-treated with these solutions, or treated by a combined dip/spray-procedure. The duration of treatment is 30 to 120 seconds preferably about 90 seconds, at a temperature of 4° C. to 50° C., preferably about 20° C.

The metal surfaces having been autodeposition coated with an uncured organic resin and then additionally protected against corrosion by the in situ formation of an (insoluble) metal chromate are subsequently cured in any known manner, for example by heating (preferably baking) to elevated temperatures of 90° C. to 150° C., preferably 110° C. The selection of the particular temperature will depend on the type of organic resin used for the coating. In this step, a completely continuous autodeposited organic resin surface is formed which, due to its content of incorporated metal chromate, substantially better protects the metal substrate against corrosion than those metal substrates having an autodeposited organic resin layer thereon which has not been autodeposition post-bath rinsed at all or which has been post-bath rinsed only with chromic acid.

EXAMPLES

General Procedure

Test sheets made of a steel material No. 1.1405 [according to German Industrial Norm (DIN); an unalloyed steel, cold-rolled, deep-draw grade; this material is used for body sheets in the automotive industry], after cleaning (1) were coated in an autodeposition coating bath having the following composition, at 20° C. ±2° C. for 90 seconds:

18.2% by weight of an anionically stabilized resin dispersion containing 33% of a binder;

5.0% by weight of an acidic aqueous ferric fluoride solution; and 76.8% by weight of fully deionized water; to produce an uncured resin coating.

The test sheets were subsequently (2) rinsed in water for 30 to 60 seconds, then (3) immersed in the respective metal salt solution as set forth in the following Table 1 at 20° C. for 90 seconds and thereafter (4) rinsed at 20° C. in a solution containing 6.15 g/l trivalent chromium(III) and 10.9 g/l hexavalent chromium(VI) for 90 seconds. Finally, (5) the test sheets were baked in an oven at 110° C. for 30 minutes. Examples 15 and 16 are for comparison.

TABLE 1

| Example | Metal Salt | pH | Metal Ion (g/l) |
|---|---|---|---|
| 1 | lead (II) acetate | 4.9[a] | 1.1 |
| 2 | " | 4.9[a] | 5.5 |
| 3 | " | 4.9[a] | 6.6 |
| 4 | barium acetate | 8.1 | 5.4 |
| 5 | " | 8.1 | 6.5 |
| 6 | strontium acetate | 8.1 | 5.1 |
| 7 | nickel acetate | 5.3[b] | 1.25 |
| 8 | " | 5.3[b] | 2.4 |
| 9 | " | 5.3[b] | 2.5 |
| 10 | " | 5.3[b] | 2.8 |
| 11 | " | 5.3[b] | 5.0 |
| 12 | cupric acetate | 5.6 | 3.2 |
| 13 | " | 5.6 | 3.8 |
| 14 | zinc acetate | 6.9 | 3.5 |
| 15 | without metal salt plus chromic acid | — | — |
| 16 | without metal salt without chromic acid | — | — |

[a]pH 6.3, adjusted to pH 4.9 using acetic acid;
[b]pH 7.8, adjusted to pH 5.3 using acetic acid The thus prepared test sheets were subjected to tests of anticorrosive properties according to DIN 53,167 and to Volkswagen(VW) Testing Standard No. 3.17.1 of Jan. 6, 1981 (Test Simulating the Action of Crushed Rock - Salt Spray Test; "Steinschlag-Salzspruehtest"). The test sheets were subjected to the test conditions for 240 hours and 480 hours, respectively and evaluated after a recovery period of 1 hour.

In the Salt Spray Test according to DIN 53,167 the infiltration (in mm) in the scribed track was examined.

In the Test Simulating the Action of Crushed Rock the test sheets were blasted with steel shot, and then the Salt Spray Test according to DIN 50,021 was conducted. After a recovery period of 1 hour the test sheets were again blasted wih steel shot, and the number and sizes of the resulting of penetrations were evaluated based on a K value of from K 1=2% of damaged area up to K 10=90% of damaged area.

The results of the examination of the test sheets is shown in Table 2.

TABLE 2

| | Salt Spray Test (mm of Infiltration) | | Test Simulating the Action of Crushed Rock (K Value after) | |
|---|---|---|---|---|
| Example | 240 hours | 480 hours | 240 hours | 480 hours |
| 1 | 0.5 | | 3–4 | |
| 2 | 0.5 | | 3–4 | |
| 3 | 0 | 0.5 | 3 | 4–5 |
| 4 | 1 | | 4–5 | |
| 5 | 1.5 | | 4–5 | |
| 6 | 1 | 2 | 4–5 | 8 |
| 7 | | 1.5 | | 5–6 |
| 8 | 0.5 | | 4 | |
| 9 | | 1.5 | | 5–6 |
| 10 | 0.5 | | 4–5 | |
| 11 | | 1 | | 5 |
| 12 | 1.5 | | 4–5 | |
| 13 | 1.5 | | 6 | |
| 14 | 1.5 | 1.5 | 4–5 | 6 |
| 15 | 1.5 | 2.5 | 5 | 7 |
| 16 | 2 | 3 | 6 | 8 |

Example 17 —In situ formation of ferrous chromate

Q-panels were processed through a 10% by weight solids of a 97.43% by weight styrene-butadiene latex autodepostion bath with 5% by volume of an activator comprising HF and ferric fluoride, and an aqueous carbon black pigment dispersion. The panels were subsequently first rinsed with an aqueous solution of ferrous gluconate (4.6 g/l) followed by a second rinse with aqueous chromic acid which was partially reduced by 37% formaldehyde (3% by weight). The rinsed, uncured autodeposited resin coating was then cured by baking at 160° C. The times for the above were: autodeposition bath—1 min; dwell—1 min; first rinse—1 min; dwell—30 sec; second rinse—1 min; cure—15 min.

Neutral Salt Spray (ASTM B117) testing of the above compared to a panel processed where a tap water rinse was substituted for the ferrous gluconate first rinse, showed the ferrous gluconate first rinsed panel to have superior anticorrosive properties. For 504 hours, the ferrous gluconate first rinse treated panel had a 5 scribe rating (3/16 inches or 4.8 mm of crepage from a scribe line) as compared a 0 scribe rating (>⅝ inches or 15.9 mm creepage) for the panel only treated with the chromic acid. This ferrous salt first rinse was in addition to, and independent of, any iron salts in the resin as the result of the autodeposition coating bath itself.

We claim:

1. In a process for autodeposition coating wherein a metal substrate is contacted with an autodeposition bath containing a latex sufficiently long for the resin in said latex to be autodeposited in an uncured state, said uncured resin is then rinsed with an anticorrosive property enhancing substance, and said rinsed uncured resin coating is then cured, the improvement of employing a two-stage rinse by:

contacting said uncured resin with a first rinse comprising at least one readily water soluble strontium, barium, lead, nickel, ferric, cupric or zinc nonchromate salt in an aqueous solution having a pH of about 4.5 to 8.5, for a time long enough and at a salt concentration high enough, for a precursor anticorrosive effective amount of said at least one salt to be incorporated within said uncured resin; and then contacting said first rinsed resin with a second rinse comprising an aqueous solution of a water soluble chromate, chromic acid, or chromic acid and partially reduced chromic acid, for a time long enough, and in a concentration high enough, to convert an anticorrosive effective amount of said percursor salt to its corresponding chromate salt in situ.

2. The process of claim 1 wherein said first rinse consists essentially of at least one of lead or nickel salt.

3. The process of claim 1 or 2 wherein said first rinse has a pH of about 4.9 to 5.3.

4. The process of claim 1 wherein each said first rinse salt anion is derived from a carboxylic or dicarboxylic acid.

5. The process of claim 1 wherein each said first rinse salt anion is acetate, propionate, or gluconate.

6. The process of claim 1 wherein said first rinse salt is present in 1–10 g/l of cation.

7. The process of claim 1 wherein said first rinse salt is present in 2.5–7 g/l of cation.

8. The process of claim 1, 2, 4 or 5 wherein said second rinse consists essentially of an aqueous solution of at least one of chromic acid, partially reduced chromic acid, potassium dichromate, magnesium dichromate, calcium dichromate, sodium chromate, or potassium chromate.

9. The process of claim 1 wherein said second rinse consists essentially of an aqueous solution of calcium dichromate.

10. The process of claim 1 wherein said second rinse consists essentially of an aqueous solution of a mixture of hexavalent chromium ions and trivalent chromium ions in a mol ratio of about 0.3–3:1.

11. The process of claim 1 or 6 wherein said second rinse contains about 1–20 g/l of chromium ions.

12. The process of claim 1 or 7 wherein said second rinse contains 5–15 g/l of chromium ions.

13. The process of claim 1 wherein the contact time for each of said first and second rinses, respectively, is about 30–120 seconds.

14. The process of claim 13 wherein said time is about 90 seconds.

15. The process of claim 1 or 13 wherein the temperature of each of said first and second rinses, respectfully, is about 4°–50° C.

16. The process of claim 15 wherein said temperature is about 20° C.

* * * * *